US006744453B2

(12) United States Patent
Sakai

(10) Patent No.: US 6,744,453 B2
(45) Date of Patent: Jun. 1, 2004

(54) IMAGE RECORDING APPARATUS AND FACSIMILE APPARATUS

(75) Inventor: Katsuyuki Sakai, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 202 days.

(21) Appl. No.: 09/950,735

(22) Filed: Sep. 13, 2001

(65) Prior Publication Data

US 2002/0030727 A1 Mar. 14, 2002

(30) Foreign Application Priority Data

Sep. 13, 2000 (JP) ..... P2000-278166

(51) Int. Cl.[7] ..... B41J 2/315; B41J 2/32

(52) U.S. Cl. ..... 347/171; 347/197

(58) Field of Search ..... 347/171, 197, 347/193; 400/120.01, 120.16, 120.17, 175

(56) References Cited

U.S. PATENT DOCUMENTS 5,115,255 A * 5/1992 Kobayashi et al. ..... 347/180
5,284,816 A * 2/1994 Stephenson ..... 503/227
5,608,440 A * 3/1997 Takebe ..... 347/171

FOREIGN PATENT DOCUMENTS

| | | |
|---|---|---|
| JP | 62-225064 | 10/1987 |
| JP | 6-345075 | 2/1988 |
| JP | 2-190352 | 7/1990 |
| JP | 3-256784 | 11/1991 |
| JP | 5-116418 | 5/1993 |
| JP | 5-160980 | 6/1993 |
| JP | 5-244337 | 9/1993 |

* cited by examiner

*Primary Examiner*—K. Feggins
(74) *Attorney, Agent, or Firm*—Birch, Stewart, Kolasch & Birch, LLP

(57) ABSTRACT

An image recording apparatus in which a line-type thermal head is used, which image recording apparatus can switch recording modes without an operation of attaching or detaching an ink ribbon cartridge and heat-sensitive recording paper by an operator. An image recording apparatus includes a line-type thermal head, a thermal-transfer recording platen and a heat-sensitive recording platen. By switching the thermal-transfer recording platen and the heat-sensitive recording platen, a thermal transfer recording mode and a heat-sensitive recording mode are switched.

8 Claims, 7 Drawing Sheets

IMAGE RECORDING APPARATUS AND FACSIMILE APPARATUS

BACKGROUND OF THE INVENTION

1. Field of the Invention

The present invention relates to an image recording apparatus of a facsimile apparatus or the like.

2. Description of the Related Art

FIG. 5 is a sectional view of a conventional image recording apparatus 1 in a thermal transfer recording mode. FIG. 6 is a sectional view of the conventional image recording apparatus 1 in a heat sensitive mode. The image recording apparatus 1 comprises a line-type thermal head 2 extending in a direction perpendicular to a paper feeding direction F (a direction perpendicular to paper of FIG. 1 or 2) which line-type thermal head 2 records line by line in the direction perpendicular to the paper feeding direction F, and a substantially cylindrical platen 3 which is disposed so as to extend in a longitudinal direction of the line-type thermal head 2. In the image recording apparatus 1, switching of recording modes is possible between a heat transfer recording mode in which recoding is carried out by transferring ink of an ink ribbon 5 to ordinary recording paper 7 as shown in FIG. 5 and a heat-sensitive recording mode in which recording is carried out by directly recording on heat-sensitive recording paper 12 as shown in FIG. 6.

In the heat transfer recording mode as shown in FIG. 5, an ink ribbon cartridge 4 is attached to the image recording apparatus 1, which ink ribbon cartridge 4 includes the ink ribbon 5, a feed roller 6*a* and a take-up roller 6*b*. Thermally-melting ink is applied to one face of the sheet-type ink ribbon 5. The ordinary recording paper 7 for use in the thermal transfer recording mode is laid on an ordinary paper sheet tray 8. The ordinary recording paper 7 laid on the ordinary paper sheet tray 8 is fed to an interval between the line-type thermal head 2 and the platen 3 which are disposed on the downstream side in the paper feeding direction F of an ordinary paper feeding roller 9 which is disposed on the downstream side in the paper feeding direction F of the ordinary paper sheet tray 8, by the ordinary paper feeding roller 9 one by one.

The ordinary paper 7 fed to the interval between the line-type thermal head 2 and the platen 3 is pressed against the line-type thermal head 2 side in the state that an image recording face of the ordinary recording paper is in intimate contact with a face to which ink of the ink ribbon 5 is applied. At that time by generating heat energy by a heat generating element of the line-type thermal head 2 which is disposed on the side of the other face to which the ink of the ink ribbon 5 is not applied the ink of the ink ribbon 5 is melted, and the ordinary recording paper 7 and the ink ribbon 5 are conveyed in the paper feeding direction F by the platen 3 to transfer the melted ink to the image recording face of the ordinary recording paper 7 to record an image.

The image-recorded ordinary paper 7 is passed through the line-type thermal head 2 and a recording paper conveying guide 10 which is displaced on the downstream side in the paper feeding direction F of the platen 3, by the platen, and is discharged to an outside of the image recording apparatus 1 by a pair of discharge rollers 11*a*, 11*b* which are displaced on the downstream side in the paper feeding direction F of the recording sheet conveying guide 10. The ink-transferred ink ribbon 5 is taken up by the take-up roller 6*b* of the ink ribbon cartridge 4.

In the heat-sensitive recording mode as shown in FIG. 6, a roll of heat-sensitive paper 12*a* which is formed by rolling heat-sensitive recording paper 12 is mounted to a portion of the image recording apparatus 1 for mounting the roll of heat-sensitive paper 13. The heat-sensitive paper 12 has an image recording face and a heat-sensitive layer formed on the image recording face which heat-sensitive layer is color-developed by heat sense when it is heated. While being pressed against the line-type thermal head 2 side, the image recording face of the heat-sensitive paper 12 is fed to the downstream side in the paper feeding direction F by the platen 3, and recording on the image recording face is carried out by heat generation of the heat generating element of the line-type thermal head 2.

The image-recorded heat-sensitive paper 12 is passed through the line-type thermal head 2 and the recording paper conveying guide 10 which is displaced on the downstream side in the paper feeding direction F of the platen 3, by the platen, and is discharged to the outside of the image recording apparatus 1 by the pair of discharge rollers 11*a*, 11*b* which are displaced on the downstream side in the paper feeding direction F of the recording sheet conveying guide 10.

When switching from the thermal transfer recording mode to the heat-sensitive recording mode, an operator of the image recording apparatus 1 opens a cover 14 of the image recording apparatus 1 to take an ink ribbon cartridge 4 out of the image recording apparatus 1, mounts a heat-sensitive paper roll 12*a* onto the image recording apparatus 1, sandwiches the heat-sensitive recording paper 12 between the line-type thermal head 2 and a platen 3, and closes the cover 14 of the image recording apparatus 1.

When switching from the heat-sensitive recording mode to the thermal transfer recording mode, an operator of the image recording apparatus 1 opens the cover 14 of the image recording apparatus 1, removes the heat-sensitive paper 12 sandwiched between the line-type thermal head 2 and the platen 3, takes the heat-sensitive paper roll 12*a* out of the image recording apparatus 1, mounts the ink ribbon cartridge 4 to the image recording apparatus 1, and closes the cover 14. A technique similar to the above is disclosed in, for example, Japanese Unexamined Patent Publication JP-A 63-45075 (1988).

In such prior arts as described above, switching from the thermal transfer recording mode to the heat-sensitive recording mode and switching from the heat-sensitive recording mode to the thermal transfer recording mode are done by an operation of attaching and detaching the ink ribbon cartridge 4 and the heat-sensitive paper roll 12*a* by an operator of the image recording apparatus 1. Thus, the conventional image recording apparatus 1 has such a problem that an operator of the image recording apparatus 1 is charged with a troublesome operation for switching. Moreover, in a case where when recording is done in either the thermal transfer recording mode or the heat-sensitive recording mode, the apparatus runs out of recording paper according to the recording mode, the apparatus cannot automatically switch to the other recording mode.

On the other hand, a recording method of automatically switching two image recording apparatuses which have different recording schemes such as an image recording apparatus of electrophotographic scheme which records on ordinary recording paper, which is excellent in preservation, and an image recording apparatus of heat sense recording type which records on heat-sensitive recording paper, which is excellent in running costs, is disclosed in Japanese Unexamined Patent Publications JP-A 62-225064 (1987) and JP-A 5-160980 (1993). However, in this case, there is such a problem that two apparatuses should be used.

As an image recording apparatus using a thermal head, an image recording apparatus wherein a serial thermal head which reciprocates in a perpendicular direction to a paper feeding direction of recording paper and records by line is used and a thermal transfer recording mode of thermally transferring an ink ribbon on ordinary recording paper and a heat-sensitive recording mode of using heat-sensitive recording paper are automatically switched is disclosed in Japanese Unexamined Patent Publications JP-A2-190352 (1990), JP-A3-256784 (1991), JP-A 5-116418 (1993) and JP-A 5-244337 (1993). Although the above apparatus can switch between the thermal transfer recording mode and the heat-sensitive recording mode in one image recording apparatus, the apparatus has such a problem that the serial thermal head reciprocates to record on recording paper and its recording speed is slower than that of an image recording apparatus using a line-type thermal head which records per row.

SUMMARY OF THE INVENTION

An object of the present invention is to provide an image recording apparatus using a line-type thermal head, which image recording apparatus can switch recording modes without an operation of attaching and detaching an ink cartridge and heat-sensitive recording paper by an operator, and provide a facsimile apparatus.

The invention provides an image recording apparatus comprising a line-type thermal head provided with a plurality of heat generating elements which are arranged along a direction crossing a paper feeding direction of recording paper, wherein recording on the recording paper is carried out by selectively causing the heat generating elements to generate heat while feeding the recording paper in the paper feeding direction, the image recording apparatus comprising:

switching means for performing switching between a thermal transfer recording mode where thermal transfer from an ink ribbon to ordinary recording paper is performed and a heat-sensitive recording mode where directly recording onto heat-sensitive recording paper is performed.

According to the invention, since the image recording apparatus comprises the switching means for performing switching between a thermal transfer recording mode where thermal transfer from an ink ribbon to ordinary recording paper is performed and a heat-sensitive recording mode where directly recording onto heat-sensitive recording paper is performed, it is possible to switch between the thermal transfer recording mode and the heat-sensitive recording mode without the need for an operator's operation of attaching/detaching an ink ribbon and heat-sensitive paper. Consequently, it is made possible to switch between the thermal transfer recording mode in which ordinary recording paper which is excellent in preservation is used and an ink ribbon is required and the heat-sensitive recording mode of using heat-sensitive recording paper which does not need an ink ribbon without the need for an operator's troublesome operation, and it is made possible to easily record image data in a recording mode responsive to an object.

In the invention it is preferable that the image recording apparatus comprises ink ribbon moving means for, in the heat-sensitive recording mode, allowing the ink ribbon to retreat from the line-type thermal head and in the thermal transfer recording mode, bringing the ink ribbon close to the line-type thermal head.

According to the invention, since the image recording apparatus comprises ink ribbon moving means for, in the heat-sensitive recording mode, allowing the ink ribbon to retreat from the line-type thermal head and in the thermal transfer recording mode, bringing the ink ribbon close to the line-type thermal head, it is ensured to, in the heat-sensitive recording mode, allow the ink ribbon to retreat from the line-type thermal head and in the thermal transfer recording mode, bring the ink ribbon close to the line-type thermal head.

Further, in the invention it is preferable that the switching means has a thermal-transfer recording platen which is used in the thermal transfer recording mode and a heat-sensitive recording platen which is used in the heat-sensitive recording mode.

It is necessary in a conventional image recording apparatus that an ink ribbon cartridge including an ink ribbon and a roll of heat-sensitive paper are replaced by an operator in switching of recording modes. However, according to the invention, since the thermal transfer recording platen and the heat-sensitive recording platen are separately provided, it is possible to easily and securely carry out switching of recording modes by replacing the platens when changing a recording mode.

In the invention it is preferable that the thermal transfer recording platen is disposed so as to be displaceable between a recording position where the thermal transfer recording platen faces the heat generating element of the line-type thermal head on an opposite side of the line-type thermal head with respect to the ink ribbon, and a first retreat position where the thermal transfer recording platen retreats from the line-type thermal head, and the heat-sensitive recording platen is disposed so as to be displaceable between a recording position where the heat-sensitive recording platen faces the heat generating element of the line-type thermal head on the line-type thermal head side with respect to the ink ribbon and a second retreat position where the heat-sensitive recording platen retreats from the line-type thermal head.

According to the invention, since in the thermal transfer recording mode, the thermal transfer recording platen is placed at the recording position where the thermal transfer recording platen faces the heat generating element of the line-type thermal head on the opposite side of the line-type thermal head with respect to the ink ribbon and the heat-sensitive recording platen is placed at the second retreat position where the heat-sensitive recording platen retreats from the line-type thermal head, it is possible in the thermal transfer recording mode to prevent the heat-sensitive platen from making contact with the ordinary recording paper and the ink ribbon. Since in the heat-sensitive recording mode, the thermal transfer recording platen is placed at the first retreat position where the thermal transfer recording platen retreats from the line-type thermal head and the heat-sensitive recording platen is placed at the recording position where the heat-sensitive recording platen faces the heat generating element of the line-type thermal head on the line-type thermal head side with respect to the ink ribbon, it is possible in the heat-sensitive recording mode to prevent the ordinary recording paper and the ink ribbon from making contact with the heat-sensitive recording platen and the heat-sensitive recording paper. It is thus ensured to switch between the two recording modes.

In the invention it is preferable that the ink ribbon is disposed so as to be capable of retreating from the heat generating element of the line-type thermal head and is taken up by the thermal transfer recording platen.

According to the invention, since the ink ribbon is taken up by the thermal transfer recording platen and is displaced so as to be capable of retreating from the heat generating element of the line-type thermal head, in the thermal transfer recording mode the ink ribbon may face the line-type thermal head when the thermal transfer recording platen is placed at the recording position, and in the heat-sensitive recording mode the ink ribbon may retreat from the line-type thermal head when the thermal transfer platen is placed at the first retreat position.

In the invention it is preferable that the ink ribbon is disposed in a state of being taken up by two ink ribbon guides which are disposed along an imaginary plane retreating from the heat generating element of the line-type thermal head, and the thermal transfer recording platen is disposed between the two ribbon guides so as to be displaceable between the recording position where the thermal transfer recording platen faces the heat generating element of the line-type thermal head and the first retreat position where the thermal transfer recording platen retreats from the line-type thermal head.

According to the invention, the ink ribbon is taken up by at least two ink ribbon guides which are disposed along an imaginary plane retreating from the heat generating element of the line-type thermal head, and the thermal transfer recording platen, which is disposed between the two ink ribbon guides so as to be displaceable between the recording position where the thermal transfer recording platen faces the heat generating element of the line-type thermal head and the first retreat position where the thermal transfer recoding platen retreats from the line-type thermal head. Accordingly the ink ribbon guides prevent a wrinkle that occurs in the ink ribbon. In the thermal transfer recording mode, when the thermal transfer recording platen is placed in the recording position, it is ensured that the thermal transfer recording platen faces the heat generating element of the line-type thermal head, and in the heat-sensitive recording mode, when the thermal transfer recording platen is placed at the first retreat position, it is ensured that the thermal transfer recording platen retreats from the heat generating element of the line-type thermal head.

In the invention it is preferable that the image recording apparatus comprises positioning means for, when the thermal transfer recording platen and the heat-sensitive recording platen are placed at the recording position, supporting the thermal transfer recording platen and the heat-sensitive recording platen from the upstream side in the paper feeding direction.

According to the invention, when the thermal transfer recording platen and the heat-sensitive recording platen are placed at the recording platen and are rotated to feed recording paper in the paper feeding direction, the positioning means controls the platens not to move in the direction counter to the paper feeding direction in order to stably support the platens at the recording position.

Still further, in the invention it is preferable that the image recording apparatus comprises:

recording paper detecting means for detecting the presence of ordinary recording paper and heat-sensitive recording paper; and control means for controlling the switching means to carry out switching of recording modes, when in recording in either one of the thermal transfer recording mode and the heat-sensitive recording mode, it is judged based on a detection result from the recording paper detecting means that there is no recoding paper corresponding to the one recording mode, from the one mode to the other mode.

According to the invention, in the case of running out of ordinary recording paper when recording in the thermal transfer recording mode, the image recording apparatus switches to the heat-sensitive recording mode, so that the apparatus can successively record on heat-sensitive recording paper. In the case of running out of heat-sensitive recording paper when recording in the heat-sensitive recording mode, the image recording apparatus switches to the thermal transfer recording mode, so that the apparatus can successively record on ordinary recording paper. Therefore, even in the case of running out of one recording paper, the image recording apparatus can successively record on the other recording paper without suspending a recording operation. Accordingly, in cases where the image recording apparatus is used in a facsimile apparatus, it is made possible that when, during facsimile reception in either one of the thermal transfer recording mode and the heat-sensitive recording mode, recording paper corresponding to the one mode is used up, the recording mode of the facsimile apparatus can be automatically switched to the other recording mode to continue the recording operation, so that it is possible to decrease communication errors because of a paper-out condition.

Still further, the invention provides a facsimile apparatus comprising:

a line-type thermal head provided with a plurality of heat generating elements which are arranged along a direction crossing a paper feeding direction of recording paper, wherein recording on the recording paper is carried out by selectively causing the heat generating elements to generate heat while feeding the recording paper in the paper feeding direction, the facsimile apparatus comprising:

switching means for performing switching between a thermal transfer recording mode where thermal transfer from an ink ribbon to ordinary recording paper is performed and a heat-sensitive recording mode where directly recording onto heat-sensitive recording paper is performed;

sender detecting means for detecting a sender;

storing means for previously registering either the thermal transfer recording mode or the heat-sensitive recording mode in correspondence with the sender; and control means for controlling, when receiving a facsimile from a sender registered in the storing means, the facsimile apparatus to record in a recording mode in correspondence with the sender.

According to the invention, when the facsimile apparatus receives a facsimile, based on a result of detecting a sender of the facsimile by the sender detecting means, the facsimile apparatus can record in a recording mode previously registered in the storing means responsive to the sender. Therefore, it is possible to, for example, use ordinary recording paper, which is excellent in preservation, to important senders, and use heat-sensitive recording paper, which is low-price, to other senders.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
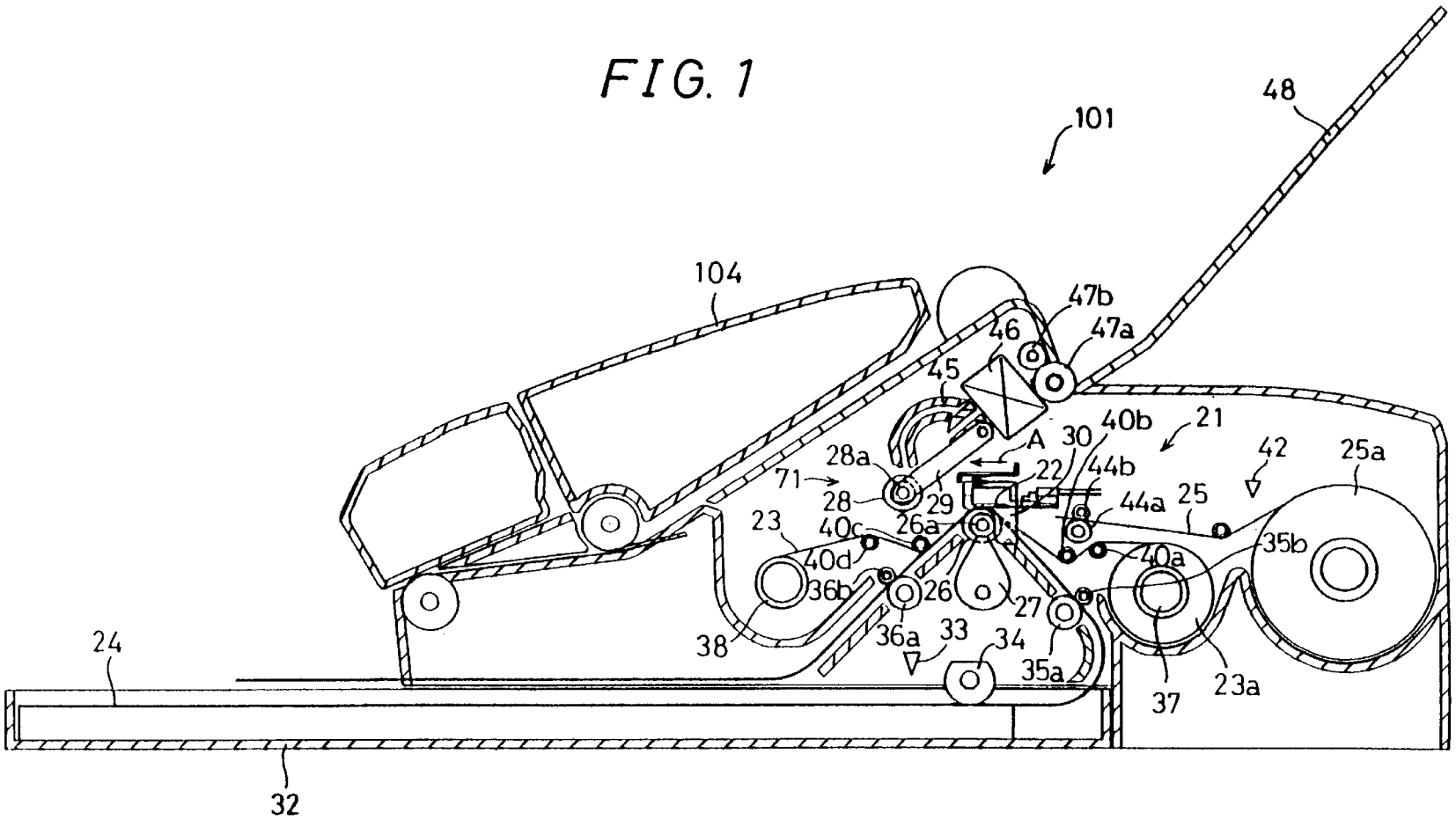
FIG. 1 is a sectional view showing an image recording apparatus 21 which is an embodiment of the present invention and a thermal transfer mode of a facsimile apparatus 101 comprising the image recording apparatus 21.

Now referring to the drawings, preferred embodiments of the invention are described below.

Figure 2:
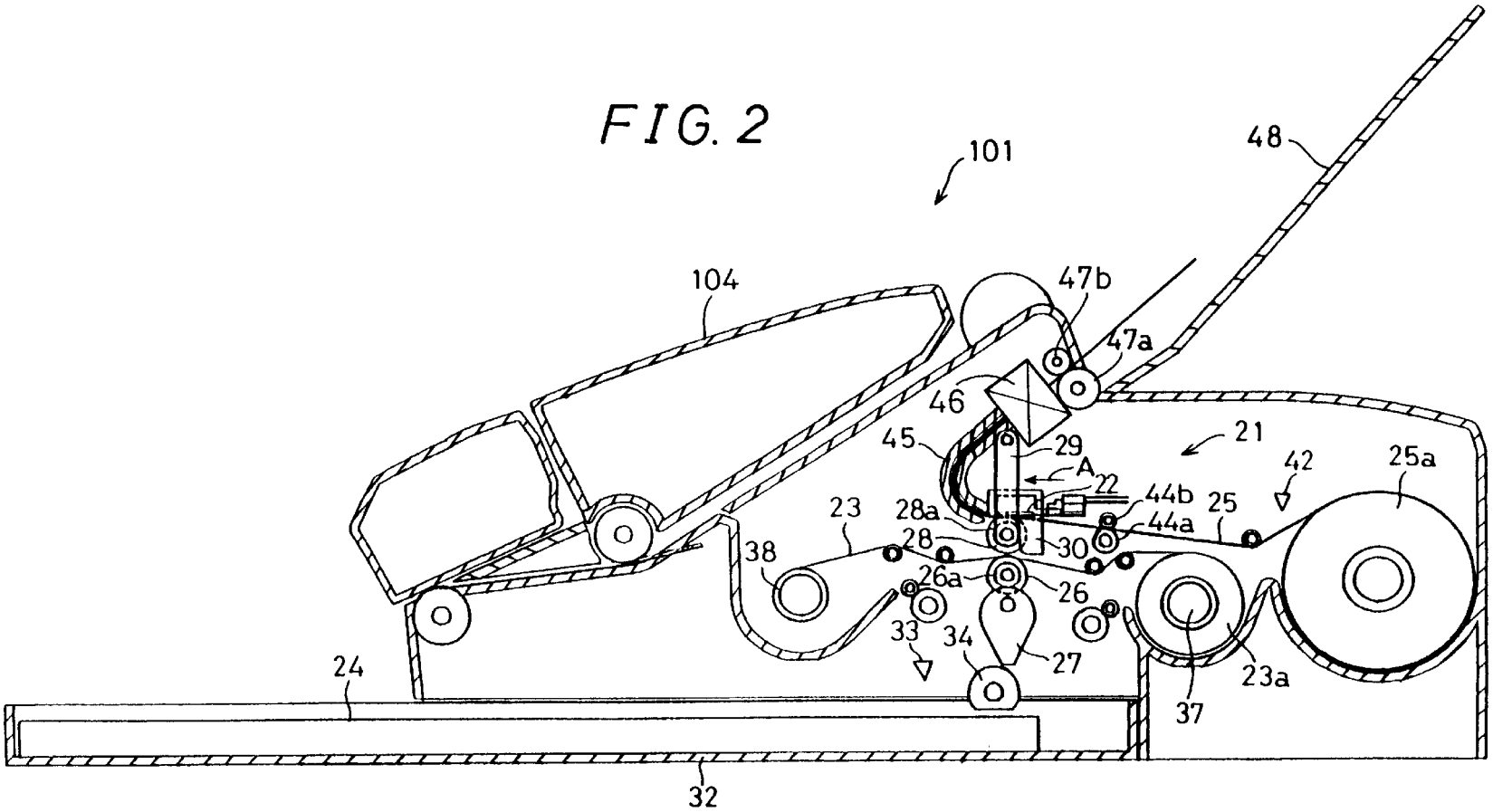
FIG. 2 is a sectional view showing the image recording apparatus 21 and the thermal transfer mode of the facsimile apparatus 101 comprising the image recording apparatus 21.

FIGS. 1 and 2 are sectional views showing a facsimile apparatus 101 comprising an image recording apparatus 21 of an embodiment of the present invention. The image recording apparatus 21 comprises a line-type thermal head 22, switching means 71, ink ribbon moving means, recording paper detecting means and control means (not shown). The image recording apparatus 21 can switch between a thermal transfer recording mode of recording by thermally transferring an ink ribbon 23 onto ordinary recording paper 24 as shown in FIG. 1 and a heat-sensitive recording mode of directly recording onto heat-sensitive recording paper 25 as shown in FIG. 2.

The line-type thermal head (hereinafter often described simply as thermal head) 22 has a plurality of heat generating elements which are arranged linearly in a width direction which is perpendicular to a paper feeding direction A of feeding the ordinary recording paper 24 and the heat-sensitive recording paper 25 (a direction perpendicular to the paper face of FIG. 1). Each heat generating element constitutes one pixel. While sending recording paper in the paper feeding direction A, the apparatus selectively causes the heat generating elements to generate heat in accordance with image signals to record onto the recording paper per line perpendicular to the paper feeding direction A, thereby recording an image onto the entire face of the recording paper.

One face of the ink ribbon 23 used in the thermal transfer recording mode is coated with thermally-melting ink. In the thermal transfer mode, image recording on the ordinary recording paper 24 is carried out in the following manner. The ink ribbon 23 and the ordinary recording paper 24 are pressed against the thermal head 22 by a thermal transfer recording platen 26 to contact the one face of the ink ribbon 23, coated with the thermally-melting ink with a recording face of the ordinary recording paper 24 and contact a face of the ink ribbon 23 which is not coated with the thermally-melting ink with a face of the thermal head 22 on which the heat generating elements are arranged, whereby the ink ribbon 23 is sandwiched between the thermal head 22 and the ordinary recording paper 24, the ink ribbon 23 and the ordinary recording paper 24 are sent in the paper feeding direction A by rotating the thermal transfer platen 26, the heat generating elements of the thermal head 22 is caused to generate heat, and the ink of the ink ribbon 23 is melted and transferred onto the ordinary recording paper 24.

On a recording face of the heat-sensitive recording paper 25 used in the heat-sensitive recording mode, a heat-sensitive layer, heated part of which senses heat and produces color, is formed. In the heat-sensitive recording mode image recording onto the heat-sensitive recording paper is carried out in the following manner. The heat-sensitive recording paper 25 is pressed against the thermal head 22 by a heat-sensitive recording platen 28 to contact the recording face of the heat-sensitive recording paper 25 with the thermal head 22 and cause the heat generating elements of the thermal head 22 to generate heat, while sending the heat-sensitive recording paper 25 in the paper feeding direction A by rotating the heat-sensitive recording platen 28, whereby the heat-sensitive layer of the recording face senses heat and produces color. The heat-sensitive recording paper 25 is mounted onto the image recording apparatus 21 in the state of a roll 25*a*.

The switching means 71 includes a thermal-transfer recording platen 26, cams 27, a heat-sensitive recording platen 28, pivot arms 29 and drive means for driving these parts. The ink ribbon moving means includes a thermal-transfer recording transfer 26, cams 27 and drive means for driving these parts.

Figure 3A:
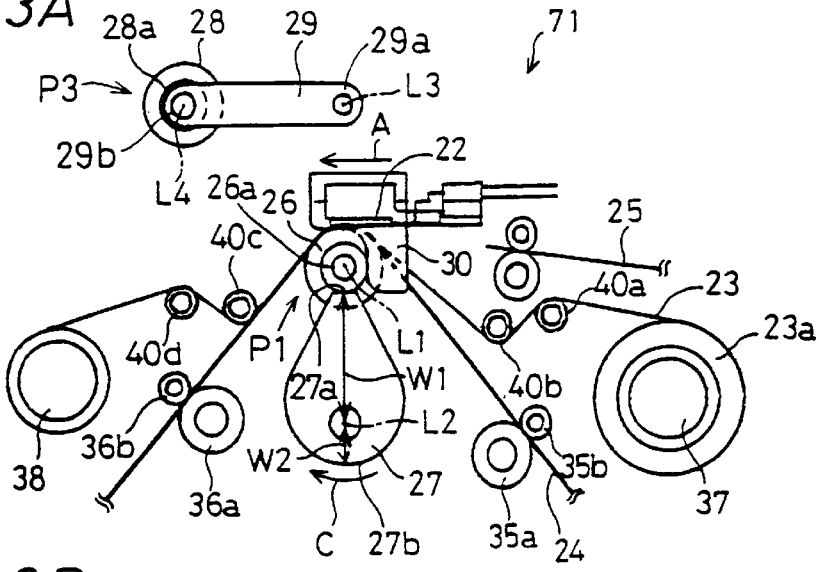
FIGS. 3A to 3C are enlarged views of part including a line-type thermal head 22 and switching means 71 of FIGS. 1 and 2 to show a procedure of switching from a thermal transfer recording mode to a heat-sensitive recording mode.
Figure 3B:
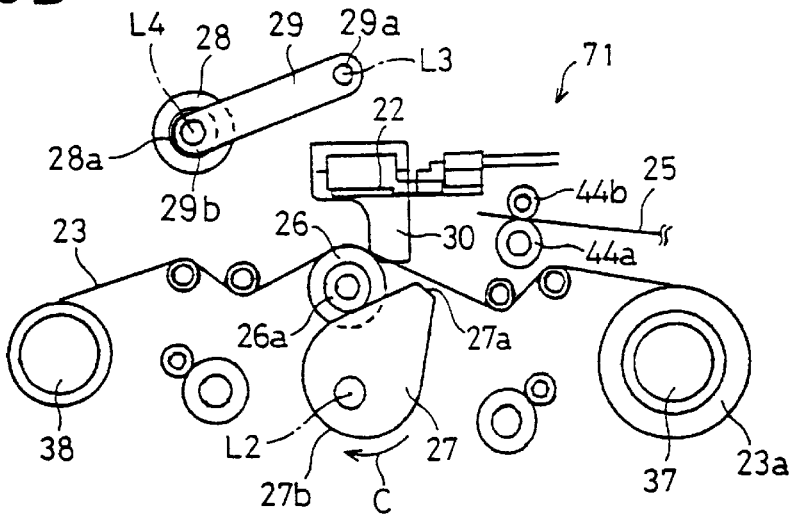
Figure 3C:
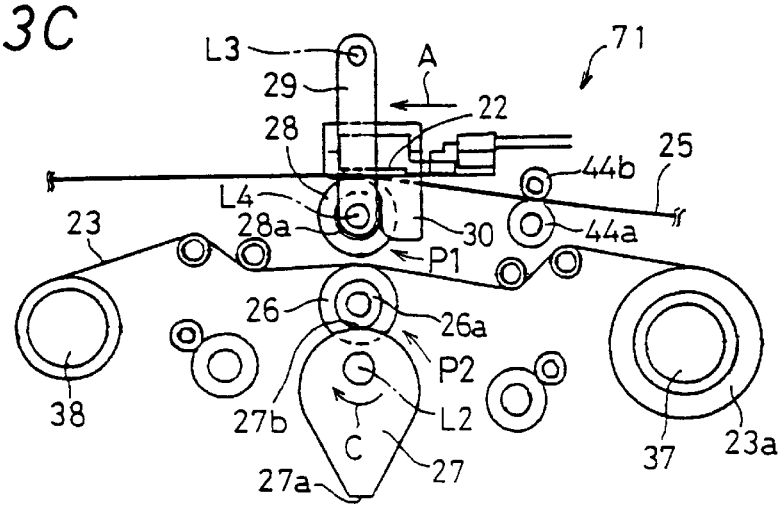

FIGS. 3A to 3C and FIGS. 4A to 4C are views illustrating procedures of switching between the thermal transfer recording mode and the heat-sensitive recording mode, in which a part including the thermal head 22 and the switching means 71 of FIGS. 1 and 2 is enlarged. The thermal-transfer recording platen 26 has a substantially cylindrical shape, extends in the width direction perpendicular to the paper feeding direction A (hereinafter often described simply as width direction), and can be driven to rotate about an axis L1 which is parallel to the width direction by the drive means such as a motor (not shown). The thermal-transfer recording platen 26 is supported so as to be movable between a platen recording position P1 where the periphery of the thermal-transfer recording platen 26 is pressed against the heat generating elements of the thermal head 22 as shown in FIG. 3A and a first platen retreat position P2 where the thermal transfer recording platen faces the heat generating elements of the thermal head 22 on the opposite side of the thermal head with respect to the ink ribbon 23 and where the thermal-transfer recording platen retreats below from the platen recording position P1 and the periphery of the thermal-transfer recording platen 26 and the thermal head 22 leaves from each other, as shown in FIG. 3C.

At both ends of the thermal transfer recording platen 26 are arranged bearings 26*a* coaxial with the thermal transfer recording platen 26. The bearing 26*a* is rotatably supported on the thermal transfer recording platen 26, and have a diameter smaller than that of the thermal transfer recording platen 26.

A pair of cams 27 are placed so as to be associated with a pair of bearings 26*a*, and supported so as to be rotatable about an axis L2 perpendicular to the paper feeding direction, respectively. As shown in FIG. 3A, the cam 27 is formed so that a distance W1 between the rotation axis L2 and one end face 27*a* thereof which is a part of the outer peripheral surface of the cam 27 is selected so as to be larger than a distance W2 between the rotation axis L2 and the other end face 27*b* thereof which is a part of the outer peripheral surface of the cam 27. When the bearings 26*a* ride on the one end faces 27*a* of the cams 27, the thermal-transfer recording platen 26 is positioned in the platen recording position P1. Moreover, the other end face 27*b* of the cam 27 is formed on a cylindrical face thereof about L2 which is a rotation axis of the cam 27, and when the bearings 26*a* are on the other end face 27*b*, the thermal-transfer recording platen 26 locates in the first platen retreat position P2. The thermal-transfer recording platen 26 receives a force toward the first platen retreat position P2, and the bearings 26*a* on both ends of the thermal-transfer recording platen 26 elastically contacts the peripheries of the cams 27 at all times, respectively. The cams 27 are rotated in an arrow C direction by a motor which is not shown. The cam 27 rotates in a state where the peripheries of the bearings 26*a* of the thermal-transfer recording platen 26 and the peripheries of the cams 27 elastically contact each other, so that the thermal-transfer recording platen 26 reciprocates between the platen recording position P1 shown in FIG. 3A and the first platen retreat position P2 shown in FIG. 3C. The ink ribbon 23 can thus be retreated from and be brought close to the thermal head 22 by the ink ribbon moving means.

At both ends of the line-type thermal head 22 are arranged a platen positioning plate 30 which is positioning means for positioning the thermal transfer recording platen 26 and the heat-sensitive recording platen 28. As shown in FIG. 3C, the platen positioning plate 30 positions so that the heat-sensitive recording platen 28 is placed in the platen recording position P1 when the heat-sensitive recording platen 28 moves below the thermal head 22 together with the pivot arms 29. At this moment, the heat-sensitive recording platen 28 faces the face having the heat generating elements of the thermal head 22 and is elastically pressed against the face of the thermal head 22.

When the thermal transfer recording platen 26 is placed at the platen recording position P1, the thermal transfer recording platen 26 faces the heat generating elements of the thermal head 22 and the bearing 26*a* of the thermal transfer recording platen 26 contacts the platen positioning plate 30 from the downstream side in the paper feeding direction A. At the platen recording position P1, when the thermal transfer recording platen 26 is rotated counterclockwise in FIG. 3A to feed the ordinary recording paper 24 and the ink ribbon 23 in the paper feeding direction A, the platen positioning plate 30 supports the bearing 26*a* of the thermal transfer recording platen 26 from the upstream side in the paper feeding direction A. Thereby the thermal transfer recording platen 26 is stably positioned at the platen recording position P1 when feeding the ordinary recording paper 24 and the ink ribbon 23 to the paper feeding direction A.

Identically, when the heat-sensitive recording platen 28 is placed at the platen recording position P1, the heat-sensitive recording platen 28 faces the heat generating elements of the thermal head 22 and the bearing 28*a* of the heat-sensitive recording platen 28 contacts the platen positioning plate 30 from the downstream side in the paper feeding direction A. At the platen recording position P1, when the heat-sensitive recording platen 28 is rotated counterclockwise in FIG. 3C to feed the heat-sensitive recording paper 25 in the paper feeding direction A, the platen positioning plate 30 supports the bearing 28a of the heat-sensitive recording platen 26 from the upstream side in the paper feeding direction A. Thereby the heat-sensitive recording platen 28 is stably positioned at the platen recording position P1 when feeding the heat-sensitive recording paper 25 to the paper feeding direction A.

As shown in FIG. 1, below the facsimile apparatus 101, a paper feeding tray 32 is placed. The paper feeding tray 32 is provided with an ordinary paper sensor 33 which detects the presence of the ordinary paper 24 and a pickup roller 34 which feeds the ordinary paper 24 one by one from the top in the paper feeding tray 32. Ordinary paper conveying rollers 35*a* and 35*b* are disposed between the pickup roller 34 and the thermal head 22, and ordinary paper discharging rollers 36*a* and 36*b* are disposed forward (leftward in FIG. 1) of the thermal head 22. The ordinary paper 24 fed backward (rightward in FIG. 1) by the pickup roller 34 is conveyed to the thermal head 22 by the ordinary paper conveying rollers 35*a* and 35*b*, and then discharged forward of the facsimile apparatus 101 by the ordinary paper discharging rollers 36*a* and 36*b*.

The ink ribbon 23 is wound around a supplying roller 37 as an ink ribbon roll 23*a* which is shaped like a roll. The supplying roller 37 has a cylindrical shape, can rotate about an axis. The ink ribbon 23 after transferring is taken up by a take-up roller 38. The take-up roller 38 has a cylindrical shape, and can be driven to rotate in a direction of taking up the ink ribbon 23 after transferring by a motor which is not shown, but it does not rotate in the opposite direction. The supplying roller 37 is placed backward of the thermal head 22, the take-up roller 38 is placed forward of the thermal head 22, and the ink ribbon 23 taken out of the supplying roller 37 is passed under the thermal head 22 and taken up by the take-up roller 38. Ink ribbon guides 40*a* and 40*b* are disposed between the supplying roller 37 and the thermal head 22 in this order in the direction from the supplying roller 37 toward the thermal head 22 so that they are below and separated from the thermal head 22, and ink ribbon guides 40*c* and 40*d* are disposed between the thermal head 22 and the take-up roller 38 in this order in the direction from the thermal head 22 toward the take-up roller 38 so that they are below and separated from the thermal head 22. The thermal transfer recording platen 26 is displaced between the platen recording position P1 and the first platen retreat position P2 between the ink ribbon guides 40*b* and 40*c*. The ink ribbon guides 40*a*, 40*b*, 40*c* and 40*d* are substantially cylindrical, extend in the width direction, and take the ink ribbon 23 up to prevent the ink ribbon 23 from being wrinkled. The ink ribbon guide 40*c* is placed between the thermal head 22 and the thermal transferring platen 26, and the ordinary paper discharging rollers 36*a* and 36*b*, thereby separating the ordinary recording paper 24 after transferring and the ink ribbon 23. In the thermal transfer recording mode, the ink ribbon 23 is placed below the thermal head 22, and the ordinary recording paper 24 is placed below the ink ribbon. The ink ribbon 23 and the ordinary recording paper are taken up by the thermal transfer recording platen 26 and in the state that they are elastically pressed against the thermal head 22 by the thermal-transfer recording platen 26, the ordinary recording paper 24 and the ink ribbon 23 are conveyed in the paper feeding direction A in synchronization with each other, whereby an image is recorded.

The heat-sensitive recording platen 28 has a substantially cylindrical shape, extends in the width direction, and can be driven to rotate about an axis L4 by a motor which is not shown. On both ends of the heat-sensitive recording platen 28, cylindrical bearings 28*a* are disposed coaxially with the heat-sensitive recording platen 28. The bearings 28*a* are rotatably supported to the heat-sensitive recording platen 28, and formed so as to have smaller outer dimensions than the heat-sensitive recording platen 28. The heat-sensitive recording platen 28 is formed so as to have the same outer diameter as the thermal-transfer recording platen 26. The bearings 28*a* are formed so as to have the same outer diameter as the bearings 26*a*.

The heat-sensitive recording platen 28 is disposed so as to be able to displace along an arc via a pair of pivot arms 29.

With regard to the pivot arms 29, a proximal end 29*a* thereof is supported on the main body of the apparatus above the thermal head 22 so as to be able to make an angular displacement about an axis L3 which is parallel to the main body of the apparatus in the width direction, and the heat-sensitive recording platen 28 is held so as to be rotatable about an axis L4 on a free end 29*b* thereof. In the thermal transfer recording mode shown in FIG. 1, the pivot arms 29 move forward (leftward in FIG. 1), and the heat-sensitive recording platen 28 retreat to the platen retreat position P3 which is a second retreat position. In the heat-sensitive recording mode shown in FIG. 2, the pivot arms 29 move backward (rightward in FIG. 2), and the heat-sensitive recording platen 28 is placed below the thermal head 22 and placed in the platen recording position P1 where the heat-sensitive recording platen faces the heat generating elements of the thermal head 22 on the thermal head 22 side with respect to the ink ribbon 23. The platen recording position P1 of the heat-sensitive recording platen 28 is the same position as the platen recording position P1 of the thermal-transfer recording platen mentioned before.

As shown in FIG. 2, when positioned in the platen recording position P1 after the pivot arms 29 move backward and the bearings 28 of the heat-sensitive recording platen 28 contact the platen positioning plate 30, the heat-sensitive recording platen 28 is elastically pressed against a face of the thermal head 22 where the heating elements are disposed. The heat-sensitive paper roll 25*a* is placed backward of the ink ribbon roll 23*a*. Between the heat-sensitive paper roll 25*a* and the thermal head 22, heat-sensitive paper conveying rollers 44*a* and 44*b* which convey the heat-sensitive paper 25 taken out of the heat-sensitive paper roll 25*a* toward the thermal head 22 are disposed. Moreover, forward of the thermal head 22, a heat-sensitive paper conveying guide 45 which guides the heat-sensitive paper 25 coming from the thermal head 22 backward is disposed. The heat-sensitive paper conveying guide 45 is attached to the pivot arms 29, and makes an angular displacement together with the pivot arms 29. An automatic cutter 46 (refer to FIG. 1) which automatically cuts the heat-sensitive recording paper 25 at a specified position thereof in the width direction is placed backward of the heat-sensitive paper conveying guide 45, and a pair of heat-sensitive paper discharging rollers 47*a* and 47*b* and a heat-sensitive paper discharging tray 48 are disposed backward of the automatic cutter.

When the heat-sensitive recording platen 28 is positioned in the platen recording position P1, the entrance of the heat-sensitive paper conveying guide 45 faces a point between the heat-sensitive recording platen 28 and the thermal head 22. Therefore, the heat-sensitive recording paper 25 conveyed forward from the heat-sensitive paper conveying rollers 44*a* and 44*b* is passed between the heat-sensitive recording platen 28 and the thermal head 22, guided by the heat-sensitive paper conveying guide 45 to be reversed backward, passed through the automatic cutter 46, and discharged backward by the heat-sensitive paper discharging rollers 47*a* and 47*b*. The heat-sensitive recording paper 25 is subjected to heat-sensitive recording while passed between the thermal head 22 and the heat-sensitive recording platen 28, cut by the automatic cutter 46 when recording for one page is completed, and discharged to the heat-sensitive paper discharging tray 48 by the heat-sensitive paper discharging rollers 47*a* and 47*b*. Moreover, a heat-sensitive paper sensor 42 which detects the presence of the heat-sensitive recording paper 25 is disposed before the heat-sensitive paper roll 25*a*.

Next, referring to FIGS. 3A to 3C, a procedure of switching from the thermal transfer recording mode to the heat-sensitive recording mode will be described. In the thermal transfer recording mode, as shown in FIG. 3A, the thermal-transfer recording platen 26 is placed in the platen recording position P1 of being pressed by the cams 27 against a face of the thermal head 22 which has the heating elements, and the heat-sensitive recording platen 28 is placed upward in the second platen retreat position P3.

When the operator pushes a switching button which locates on an operation panel 104 of the facsimile apparatus 101 and switches from the thermal transfer recording mode to the heat-sensitive recording mode, the ordinary recording paper 24 is discharged outside the facsimile apparatus 101 when the ordinary recording paper 24 exists between the thermal head 22 and the thermal-transfer recording platen 26. After that, the cams 27 are driven to rotate in an arrow C direction (a clockwise direction in FIG. 3), and the supplying roller 37 is driven to rotate in a direction of taking up the ink ribbon 23. As a result, the thermal-transfer recording platen 26 is pressed from the platen recording position P1 toward the first platen retreat position P2 by the ink ribbon 23, and placed in the first platen retreat position P2 as shown in FIG. 3C in a state where the respective bearings 26*a* on both ends of the thermal-transfer recording platen 26 elastically contact the peripheries of the corresponding cams 27 at all times as shown in FIG. 3B. At this moment the ink ribbon 23 retreats from the heat generating elements of the thermal head 22. When the thermal-transfer recording platen 26 moves from the platen recording position P1 to the first platen retreat position P2, the pivot arms 29 pivot backward, and the heat-sensitive recording platen 28 moves from the second platen retreat position P3 toward the platen recording position P1. As a result that the heat-sensitive recording platen 28 moves below the thermal head 22 to be positioned by the platen positioning plate 30, the heat-sensitive recording platen 28 is placed in the platen recording position P1 as shown in FIG. 3C. At this moment, the heat-sensitive recording platen 28 does not come in contact with the ink ribbon 23 or the thermal-transfer recording platen 26. After that, the heat-sensitive recording paper 25 is supplied between the thermal head 22 and the heat-sensitive recording platen 28.

Figure 4A:
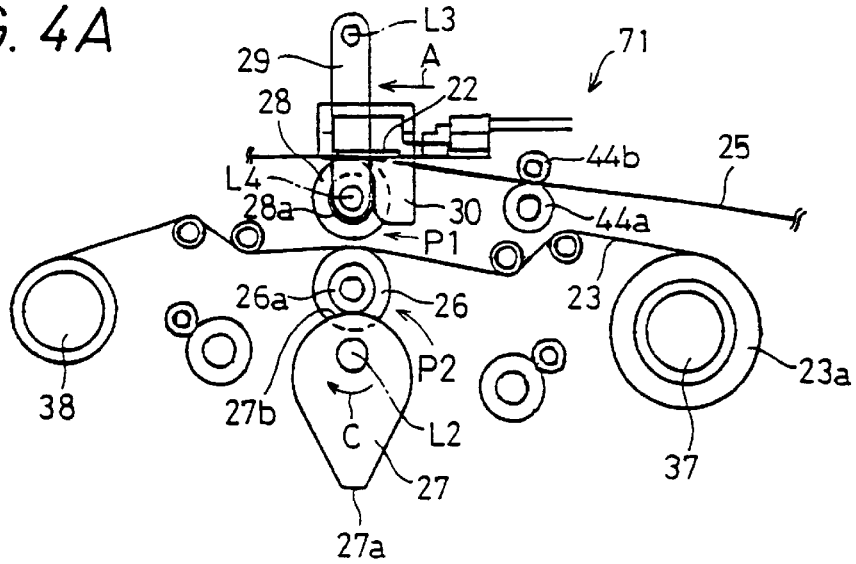
FIGS. 4A to 4C are enlarged views of the part including the line-type thermal head 22 and the switching means 71 of FIGS. 1 and 2 to show a procedure of switching from the heat-sensitive recording mode to the thermal transfer recording mode.
Figure 4B:
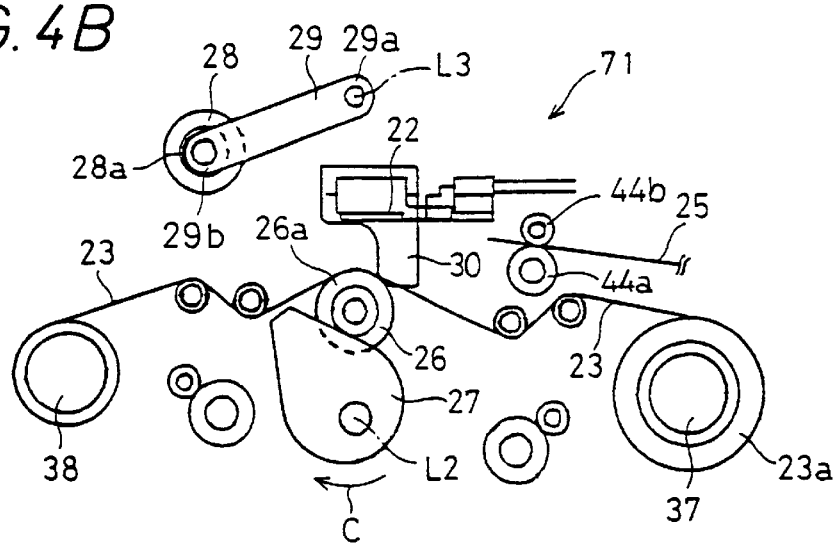
Figure 4C:
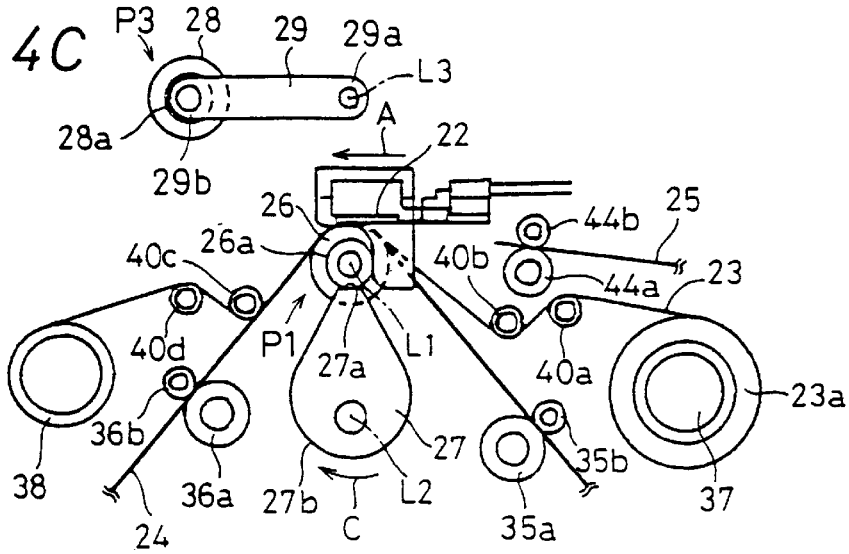
Figure 5:
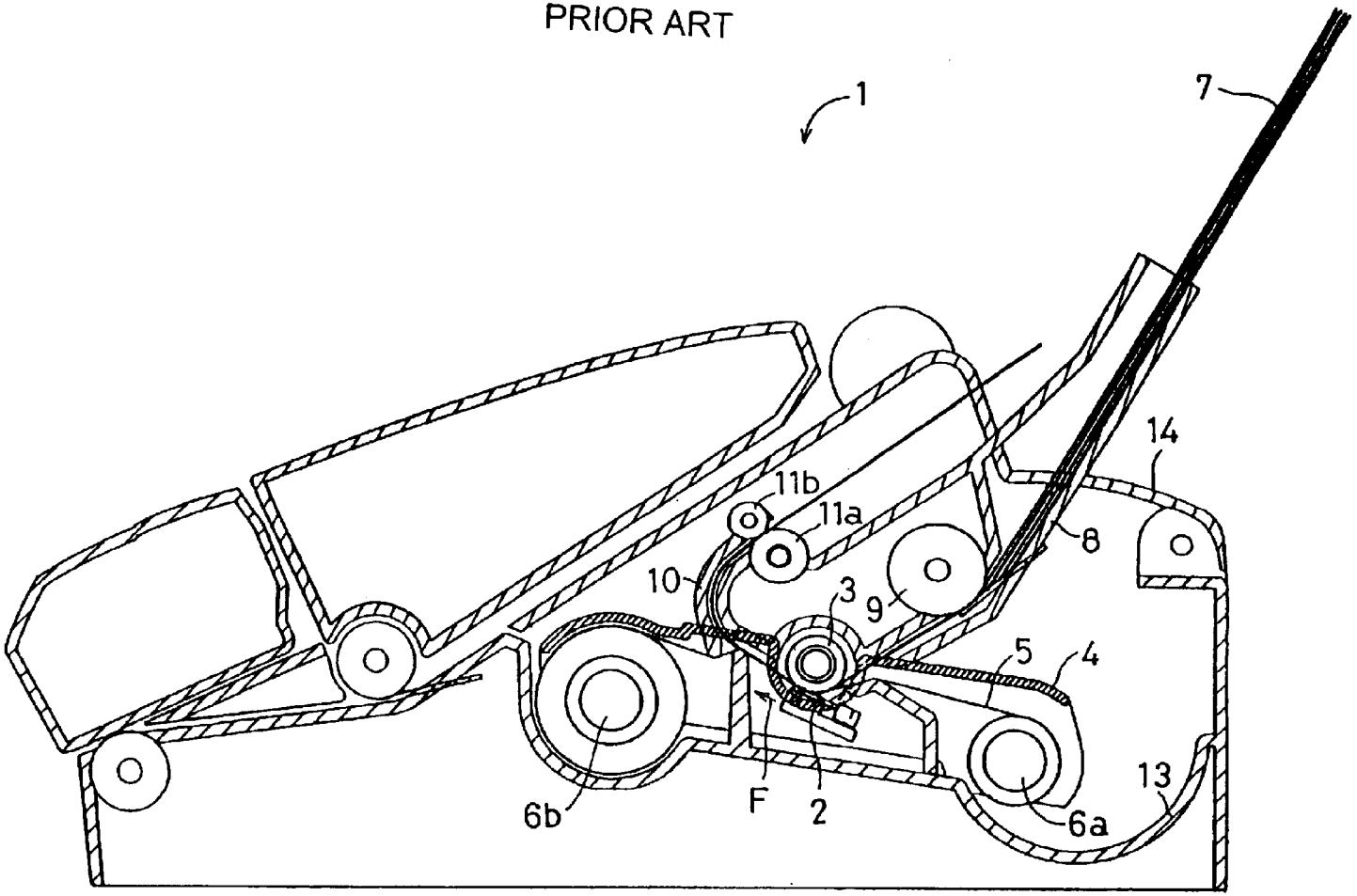
FIG. 5 PRIOR ART
FIG. 5 is a sectional view showing a state where an image recording apparatus 1 of a prior art is in the thermal transfer recording mode.
Figure 6:
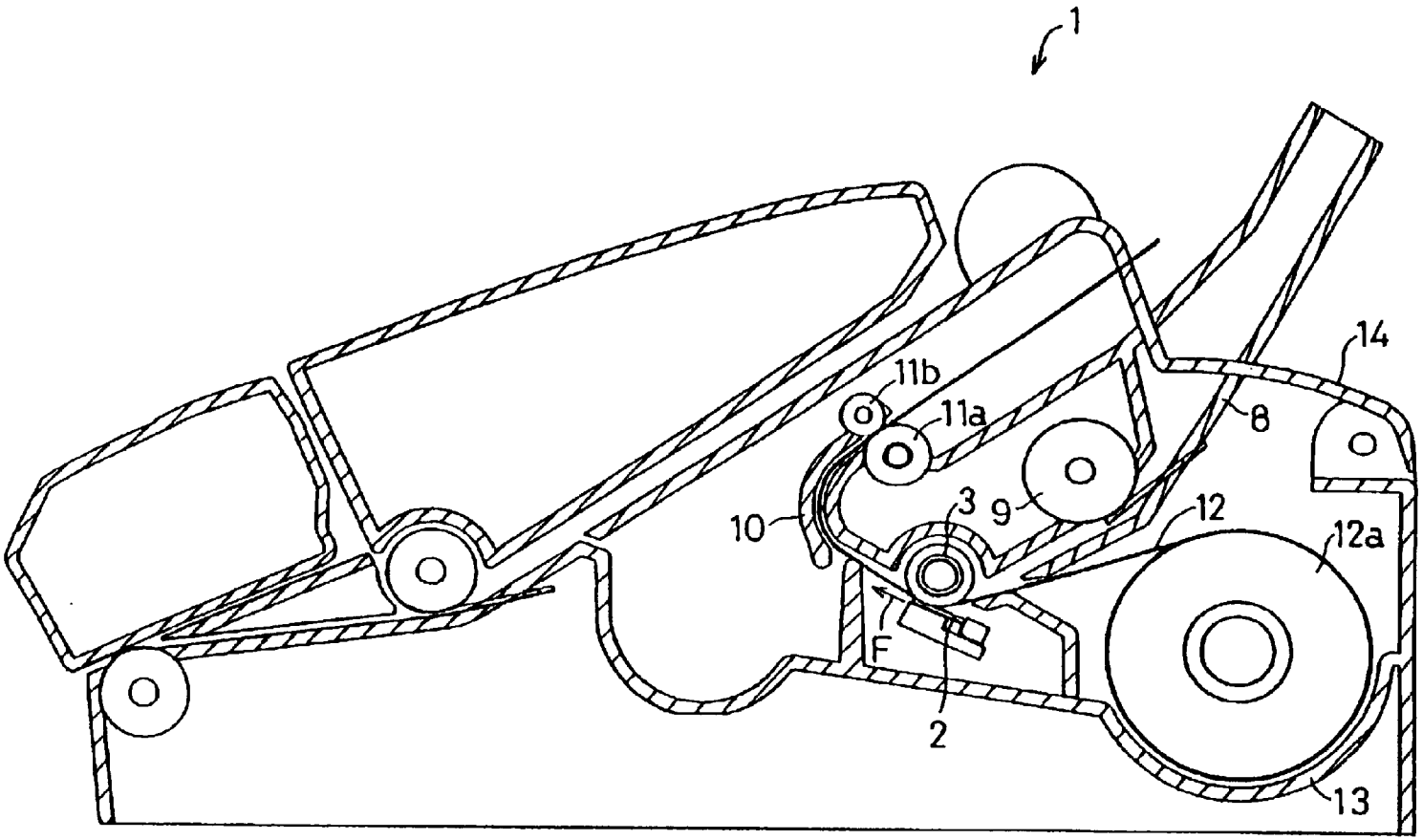
FIG. 6 PRIOR ART
FIG. 6 is a sectional view showing a state where the image recording apparatus 1 is in the heat-sensitive recording mode.
Figure 7:
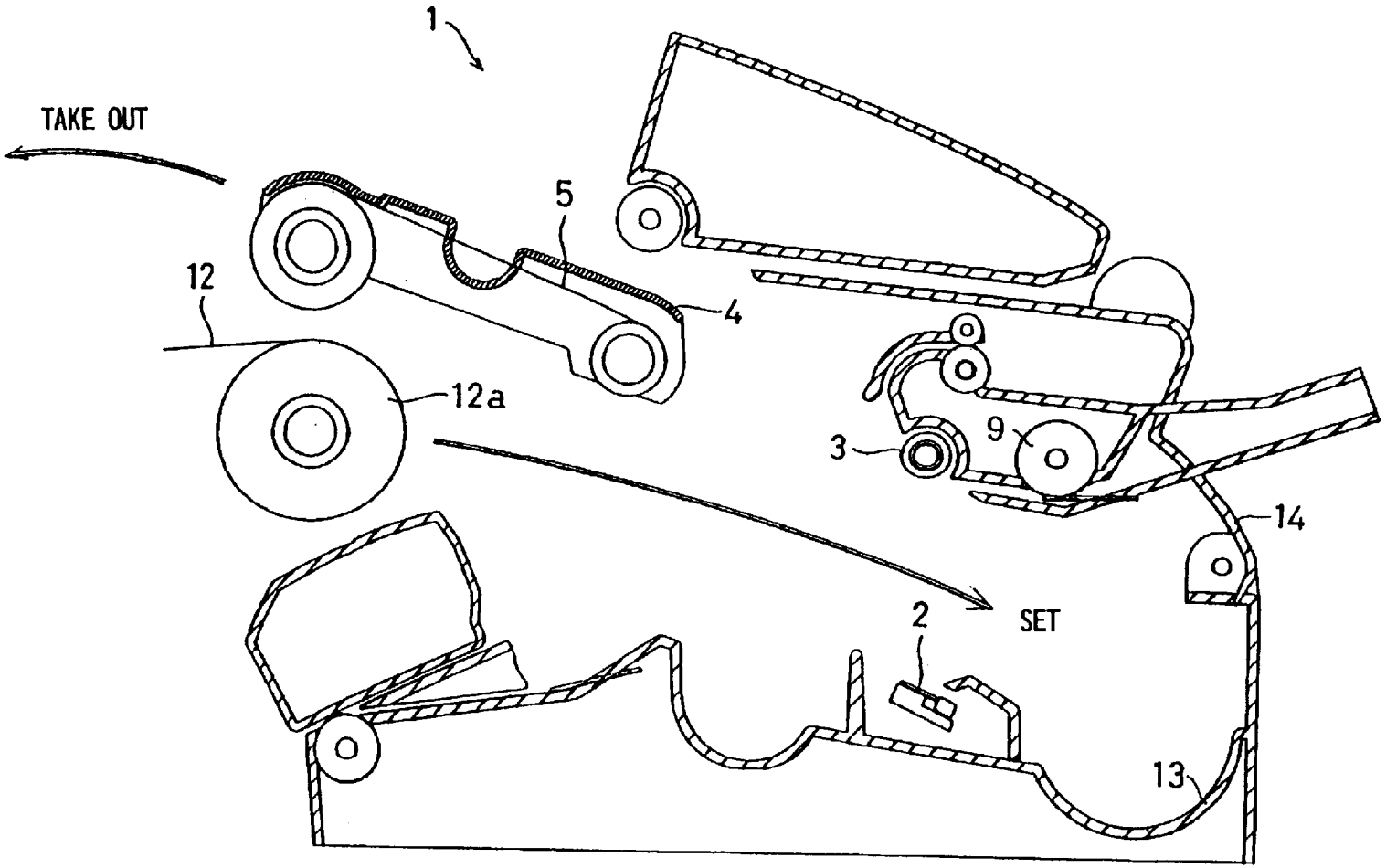
FIG. 7 PRIOR ART
FIG. 7 is a sectional view showing an operation of switching between the thermal transfer recording mode and the heat-sensitive recording mode in the image recording apparatus 1.

Next, referring to FIGS. 4A to 4C, a procedure of switching from the heat-sensitive recording mode to the thermal transfer recording mode will be described. In the heat-sensitive recording mode, as shown in FIG. 4A, the heat-sensitive recording platen 28 is placed in the platen recording position P1 of being pressed against a face of the thermal head 22 which has the heating elements by the pivot arms 29 and the platen positioning plate 30, and the thermal-transfer recording platen 26 is placed in the first platen retreat position P2 by the cams 27 and the ink ribbon 23.

When the operator pushes a switching button which locates on the operation panel 104 of the facsimile apparatus 101 and switches from the heat-sensitive recording mode to the thermal transfer recording mode, the tip end of the heat-sensitive recording paper 25 is returned backward (rightward in FIG. 4A) of the thermal head 22 by the heat-sensitive recording platen 28 and the heat-sensitive paper conveying rollers 44*a* and 44*b* when the heat-sensitive recording paper 25 exists between the thermal head 22 and the heat-sensitive recording platen 26. After that, the pivot arms 29 pivot forward, and the heat-sensitive recording platen 28 leaves from the thermal head 22, thereby being placed in the second platen retreat position P3 as shown in FIG. 4C. At this moment, the cams 27 are driven to rotate in the arrow c direction (a clockwise direction in FIG. 4A). As a result, as shown in FIG. 4B, the thermal-transfer recording platen 26 moves from the first platen retreat position P2 to the platen recording position P1 in a state where the respective bearings 26*a* on both ends of the thermal-transfer recording platen 26 elastically contact the peripheries of the opposed cams 27 at all times. At this moment, the ink ribbon 23 is pulled by the thermal-transfer recording platen 26 in a direction of supplying the ink ribbon 23, whereby the supplying roller 37 rotates in a direction of taking up the ink ribbon 23. The cams 27 rotate in the arrow C direction, the bearings 26*a* of the thermal-transfer recording platen 26 ride on one end faces 27*a* of the cams 27, and the thermal-transfer recording platen 26 is placed in the platen recording position P1 as shown in FIG. 4C. At this moment, the heat-sensitive recording platen 28 does not come in contact with the ink ribbon 23, the ordinary recording paper 24 or the thermal-transfer recording platen 26. After that, the ordinary recording paper 24 is conveyed to between the thermal transferring platen 26 and the ink ribbon 23.

The image recording apparatus 21 is provided with recording paper detecting means and control means. The recording paper detecting means consists of an ordinary paper sensor 33 and a heat-sensitive paper sensor 42. The ordinary paper sensor 33 detects the presence of the ordinary recording paper 24 in the paper feeding tray 32 and gives a detection signal to the control means. The heat-sensitive paper sensor 42 detects the presence of the heat-sensitive recording paper 25 in the image recording apparatus 21 and gives a detection signal to the control means. The control means controls switching means 71 based on a detection result of the recording paper detecting means so as to switch a recording mode.

In specific, in a case where the apparatus runs out of the ordinary recording paper 24 when recording on the ordinary recording paper 24 in the thermal transfer recording mode, the ordinary paper sensor 33 detects that the ordinary recording paper 24 is exhausted and gives the control means a detection signal indicating that the ordinary recording paper 24 is exhausted. The control means controls the cams 27, the supplying roller 37 and the pivot arms 29 based on the detection signal given by the ordinary paper sensor 33, thereby placing the thermal-transfer recording platen 26 located in the platen recording position P1 to the first platen retreat position P2 and placing the heat-sensitive recording platen 28 located in the second platen retreat position P3 to the platen recording position P1.

In a case where the apparatus runs out of the heat-sensitive recording paper 25 when recording on the heat-sensitive recording paper 25 in the heat-sensitive recording mode, the heat-sensitive paper sensor 42 detects that the heat-sensitive recording paper 25 is exhausted and gives the control means a detection signal indicating that the heat-sensitive recording paper 25 is exhausted. The control means controls the cams 27 and the pivot arms 29 based on the detection signal given by the heat-sensitive paper sensor 42, thereby placing the heat-sensitive recording platen 28 located in the platen recording position P1 to the second platen retreat position P3 and placing the thermal-transfer recording platen 26 located in the first platen retreat position P2 to the platen recording position P1.

Further, the facsimile apparatus 101 is provided with sender detecting means and storing means. The sender detecting means detects the telephone number of a facsimile sender through a telephone number notification service. It is possible to previously register recording modes corresponding to telephone numbers of individual facsimile senders in the storing means.

In specific, when a facsimile is received, the sender detecting means detects the telephone number of the sender of the facsimile. Assuming that the detection result is ○○-◎◎◎◎-X X X X and it is previously registered in the storing means that a recording mode corresponding to the telephone number ○○-◎◎◎◎-X X X X is the thermal transfer recording mode, the image recording apparatus 21 of the facsimile apparatus 101 records the received facsimile on the ordinary recording paper 24 in the thermal transfer recording mode. Assuming that the result of detecting the sender when the facsimile is received is ○○-◎◎◎◎-#### and it is previously registered in the storing means that a recording mode corresponding to the telephone number ○○-◎◎◎◎-#### is the heat-sensitive recording mode, the image recording apparatus 21 of the facsimile apparatus 101 records the received facsimile on the heat-sensitive recording paper 25 in the heat-sensitive recording mode.

Further, the apparatus is set to, when a facsimile from a sender who is not registered is received, record in the heat-sensitive recording mode, for example.

According to the image recording apparatus 21 of this embodiment, it is possible to automatically switch between the thermal transfer recording mode and the heat-sensitive recording mode without an operation of attaching or detaching the ink ribbon 23 and the heat-sensitive paper roll 25*a* by the operator of the image recording apparatus having the line-type thermal head 22. Therefore, it is possible to switch between the thermal transfer recording mode of using the ordinary recording paper 24, which is excellent in preservation, and the heat-sensitive recording mode of using the heat-sensitive recording paper 25, which does not need the ink ribbon 23, without the inconvenience for the operator, and it is possible to easily record image data in a recording mode responsive to an object.

Although it is necessary to replace an ink ribbon cartridge and a heat-sensitive paper roll when changing a recording mode in prior arts, the image recording apparatus 21 of this embodiment is equipped with the thermal-transfer recording platen 26 and the heat-sensitive recording platen 28 separately, so that it is possible to easily change a recording mode by replacing the platens 26 and 28 when changing a recording mode.

Furthermore, according to the image recording apparatus 21 of the embodiment, since in the thermal transfer recording mode, the thermal transfer recording platen 26 is placed at the recording position P1 where the thermal transfer recording platen 26 faces the heat generating element of the line-type thermal head 22 on the opposite side of the line-type thermal head 22 with respect to the ink ribbon 23 and the heat-sensitive recording platen 28 is placed at the second retreat position where the heat-sensitive recording platen 28 retreats from the line-type thermal head 22, it is possible in the thermal transfer recording mode to prevent the heat-sensitive platen from making contact with the ordinary recording paper 24 and the ink ribbon 23. Since in the heat-sensitive recording mode, the thermal transfer recording platen 26 is placed at the first retreat position P2 where the thermal transfer recording platen 26 retreats from the line-type thermal head 22 and the heat-sensitive recording platen 28 is placed at the recording position P1 where the heat-sensitive recording platen 28 faces the heat generating element of the line-type thermal head 22 on the line-type thermal head 22 side with respect to the ink ribbon 23, it is possible in the heat-sensitive recording mode to prevent the ordinary recording paper 24 and the ink ribbon 23 from making contact with the heat-sensitive recording platen 28 and the heat-sensitive recording paper. It is thus ensured to switch between the two recording modes.

According to the image recording apparatus 21 of the embodiment, since the ink ribbon 23 is taken up by the thermal transfer recording platen 26 and is displaced so as to be capable of retreating from the heat generating element of the line-type thermal head 22, in the thermal transfer recording mode the ink ribbon 23 may face the line-type thermal head 22 when the thermal transfer recording platen 26 is placed at the recording position P1, and in the heat-sensitive recording mode the ink ribbon 23 may retreat from the line-type thermal head 22 when the thermal transfer platen is placed at the first retreat position P2.

According to the image recording apparatus of the embodiment, the ink ribbon 23 is taken up by at least two ink ribbon guides 40i b, 40*c* which are disposed along an imaginary plane retreating from the heat generating element of the line-type thermal head 22, and the thermal transfer recording platen 26, which is disposed between the two ink ribbon guides 40*b*, 40*c* so as to be displaceable between the recording position P1 where the thermal transfer recording platen 26 faces the heat generating element of the line-type thermal head 22 and the first retreat position P2 where the thermal transfer recoding platen retreats from the line-type thermal head 22. Accordingly the ink ribbon guides 40*b*, 40*c* prevent a wrinkle that occurs in the ink ribbon 23. In the thermal transfer recording mode, when the thermal transfer recording platen 26 is placed in the recording position P1, it is ensured that the thermal transfer recording platen 26 faces the heat generating element of the line-type thermal head 22, and in the heat-sensitive recording mode, when the thermal transfer recording platen 26 is placed at the first retreat position P2, it is ensured that the thermal transfer recording platen 26 retreats from the heat generating element of the line-type thermal head 22.

Furthermore, according to the image recording apparatus 21 of this embodiment, even in a case where one recording paper is exhausted, it is possible to successively record on the other recording paper without suspending a recording operation.

According to the facsimile apparatus 101 in which the image recording apparatus 21 of this embodiment is used, in a case where when recording in either the thermal transfer recording mode or the heat-sensitive recording mode, the apparatus runs out of recording paper for the present recording mode while receiving a facsimile, the apparatus can switch to the other recording mode and successively record, so that it is possible to decrease communication errors because of exhaustion of recording paper.

When a recording mode is switched from the thermal transfer recording mode to the heat-sensitive recording mode, the thermal-transfer recording platen 26 located in the platen recording position P1 is pressed toward the first platen retreat position P2 by the ink ribbon 23, so that it is possible to reliably release the thermal-transfer recording platen 26 from the platen recording position P1 and place in the first platen retreat position P2.

The image recording apparatus 21 according to the invention may be used as a printing apparatus which records image data sent from a personal computer on recording paper instead of being used in a facsimile apparatus.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An image recording apparatus comprising:

a line-type thermal head provided with a plurality of heat generating elements which are arranged along a direction crossing a paper feeding direction of recording paper, wherein recording on the recording paper is carried out by selectively causing the heat generating elements to generate heat while feeding the recording paper in the paper feeding direction, the image recording apparatus further comprising:

switching means for performing switching between a thermal transfer recording mode where thermal transfer from an ink ribbon to ordinary recording paper is performed and a heat-sensitive recording mode where directly recording onto heat-sensitive recording paper is performed.

2. The image recording apparatus of claim 1, comprising:

ink ribbon moving means for, in the heat-sensitive recording mode, allowing the ink ribbon to retreat from the line-type thermal head and in the thermal transfer recording mode, bringing the ink ribbon close to the line-type thermal head.

3. The image recording apparatus of claim 1, wherein the switching means has a thermal-transfer recording platen which is used in the thermal transfer recording mode and a heat-sensitive recording platen which is used in the heat-sensitive recording mode.

4. The image recording apparatus of claim 3, wherein the thermal transfer recording platen is disposed so as to be displaceable between a recording position where the thermal transfer recording platen faces the heat generating element of the line-type thermal head on an opposite side of the line-type thermal head with respect to the ink ribbon, and a first retreat position where the thermal transfer recording platen retreats from the line-type thermal head, and the heat-sensitive recording platen is disposed so as to be displaceable between a recording position where the heat-sensitive recording platen faces the heat generating element of the line-type thermal head on the line-type thermal head side with respect to the ink ribbon and a second retreat position where the heat-sensitive recording platen retreats from the line-type thermal head.

5. The image recording apparatus of claim 4, wherein the ink ribbon is disposed so as to be capable of retreating from the heat generating element of the line-type thermal head and is taken up by the thermal transfer recording platen.

6. The image recording apparatus of claim 5, wherein the ink ribbon is disposed in a state of being taken up by two ink ribbon guides which are arranged along an imaginary plane retreating from the heat generating element of the line-type thermal head, and the thermal transfer recording platen is disposed between the two ribbon guides so as to be displaceable between the recording position where the thermal transfer recording platen faces the heat generating element of the line-type thermal head and the first retreat position where the thermal transfer recording platen retreats from the line-type thermal head.

7. The image recording apparatus of claim 4, comprising:

positioning means for, when the thermal transfer recording platen and the heat-sensitive recording platen are placed at the recording position, supporting the thermal transfer recording platen and the heat-sensitive recording platen from the upstream side in the paper feeding direction.

8. The image recording apparatus of claim 1, comprising:

recording paper detecting means for detecting the presence of ordinary recording paper and heat-sensitive recording paper; and control means for controlling the switching means to carry out switching of recording modes, when in recording in either one of the thermal transfer recording mode and the heat-sensitive recording mode, it is judged based on a detection result from the recording paper detecting means that there is no recoding paper corresponding to the one recording mode, from the one mode to the other mode.

* * * * *